US007416518B2

(12) United States Patent
Cardinale

(10) Patent No.: US 7,416,518 B2
(45) Date of Patent: Aug. 26, 2008

(54) EXERCISE APPARATUS

(75) Inventor: Marco Cardinale, Aberdeen (GB)

(73) Assignee: Aberdeen University (GB)

( * ) Notice: Subject to any disclaimer, the term of this patent is extended or adjusted under 35 U.S.C. 154(b) by 29 days.

(21) Appl. No.: 10/522,020

(22) PCT Filed: Jul. 22, 2003

(86) PCT No.: PCT/GB03/03258

§ 371 (c)(1),
(2), (4) Date: Sep. 13, 2005

(87) PCT Pub. No.: WO2004/009173

PCT Pub. Date: Jan. 29, 2004

(65) Prior Publication Data

US 2006/0148623 A1 Jul. 6, 2006

(30) Foreign Application Priority Data

Jul. 22, 2002 (GB) ..... 0216982.9

(51) Int. Cl.
*A63B 21/00* (2006.01)
*A63B 24/00* (2006.01)
*A61H 1/00* (2006.01)

(52) U.S. Cl. ..... 482/92; 482/1; 601/23

(58) Field of Classification Search ..... 601/23; 482/1, 92

See application file for complete search history.

(56) References Cited

U.S. PATENT DOCUMENTS

| | | | | |
|---|---|---|---|---|
| 4,705,271 | A * | 11/1987 | Mondloch et al. | 482/112 |
| 5,857,986 | A * | 1/1999 | Moriyasu | 601/49 |
| 6,039,679 | A | 3/2000 | Yu | |
| 6,087,942 | A * | 7/2000 | Sleichter et al. | 340/576 |
| 6,217,491 | B1 * | 4/2001 | Schiessl | 482/92 |
| 2003/0135140 | A1 * | 7/2003 | Bosco | 601/46 |
| 2004/0068211 | A1 * | 4/2004 | Leivseth et al. | 601/49 |

FOREIGN PATENT DOCUMENTS

| | | |
|---|---|---|
| EP | 0335616 | 10/1989 |
| EP | 1121956 | 8/2001 |
| SU | 1447385 A | 12/1988 |
| WO | 02/053084 A | 7/2002 |
| WO | WO 02/053084 A1 * | 7/2002 |

* cited by examiner

*Primary Examiner*—LoAn H. Thanh
*Assistant Examiner*—Allana Lewin
(74) *Attorney, Agent, or Firm*—Lowe Hauptman Ham & Berner, LLP

(57) ABSTRACT

Apparatus for muscular stimulation of a user includes a pressure sensor, a control unit to which pressure values sensed by the pressure sensor are fed, and a vibrational stimulator for applying vibrational stimulation. The vibrational stimulator is activated by the control unit in response to the pressure sensor sensing an applied pressure which exceeds a threshold-pressure value.

27 Claims, 2 Drawing Sheets

EXERCISE APPARATUS

CROSS-REFERENCE TO RELATED APPLICATIONS

Figure 1:
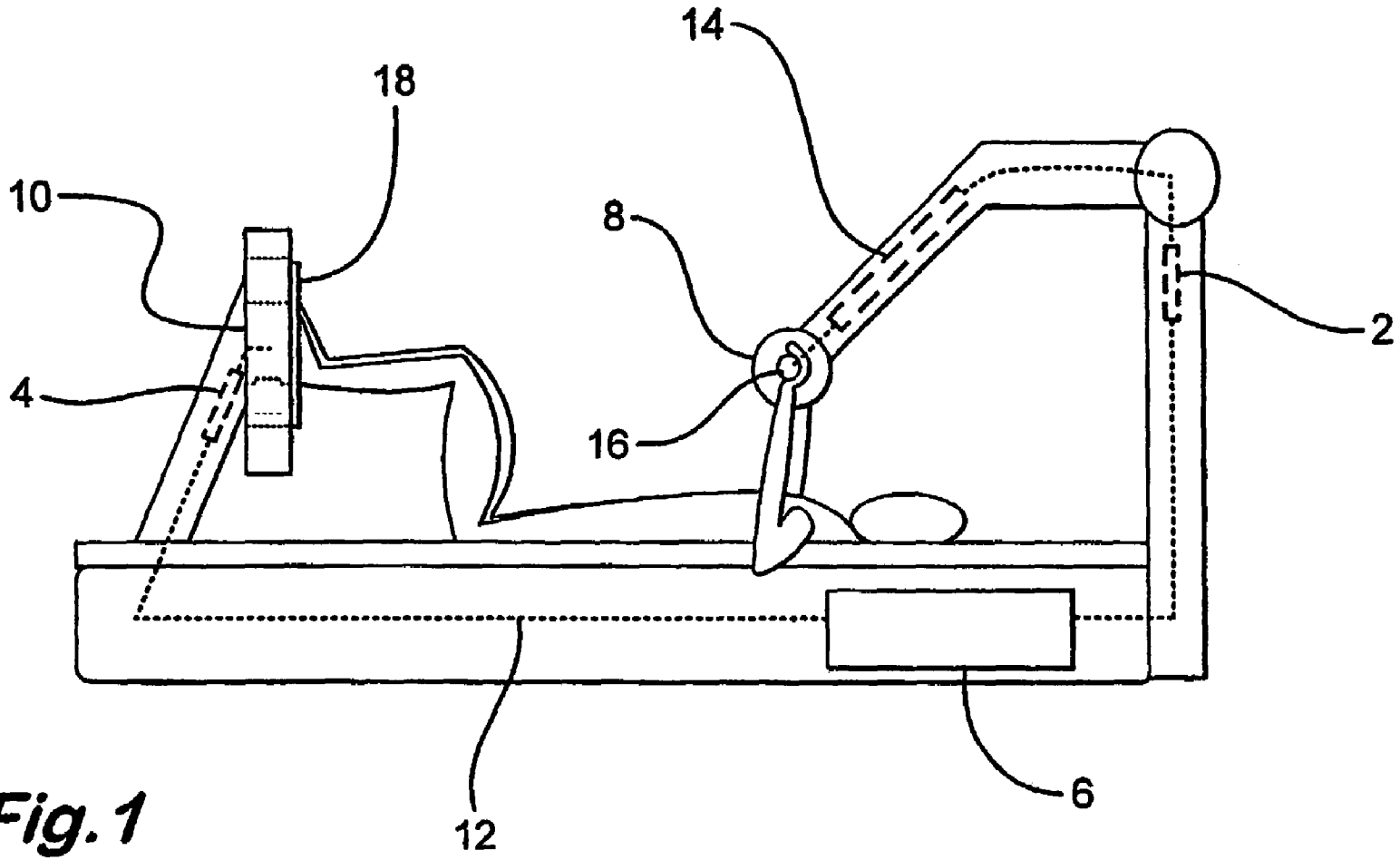

The present Application is based on International Application No. PCT/GB2003/003258, filed on Jul. 22, 2003, which in turn corresponds to GB 0216982.9 filed on Jul. 22, 2002, and priority is hereby claimed under 35 U.S.C § 119 based on these applications. Each of these applications are hereby incorporated by reference in their entirety into the present application.

The present invention relates to apparatus and a method for muscular stimulation, in particular apparatus and a method for muscular stimulation by applying vibrational stimulation.

A muscle will undergo reflex contractions when stimulated by the application of mechanical vibrations, in a similar way to voluntary muscle contractions due to physical exertion. Accordingly, devices are known for muscular stimulation by the application of mechanical vibrations. Such devices can be useful for athletic training, since improved muscle tone of a user can be achieved without physical exercise, for example in the home, and in a shorter period of time than could be achieved by physical exercise. Such devices can also be of therapeutic use during recovery of a user from, for example, an accident or surgery, and have been shown to be effective in increasing bone density. However, such devices suffer from the drawback that they require no physical exertion by the user, and hence contribute little to the fitness of the user, and provide a stimulus which is not determined by the physical exertion of the user.

The present invention seeks to provide apparatus and a method for overcoming the drawbacks of the prior art.

According to the present invention there is provided apparatus for muscular stimulation of a user, which apparatus comprises a pressure sensor, a control unit to which pressure values sensed by the pressure sensor are fed, and a vibrational stimulator for applying vibrational stimulation, wherein the vibrational stimulator is activated by the control unit in response to the pressure sensor sensing an applied pressure which exceeds a threshold pressure value, and wherein the vibrational stimulator can apply vibrational stimulation to a user via a unit which can reciprocally move relative to a user in response to the pressure sensor sensing an applied pressure which exceeds the threshold pressure.

The apparatus according to the present invention thus provides vibrational stimulation to a user in response to the pressure sensor sensing an applied pressure by the user above a threshold value. Thus, the user must expend a certain amount of physical effort in order to activate the vibrational stimulator, the amount of physical effort required being determined by the level at which the threshold pressure value is set.

Preferably, the vibrational stimulator is deactivated when the pressure sensor ceases to sense an applied pressure which exceeds the threshold pressure value. In this way, the user must continue to apply a pressure above the threshold value in order for the vibrational stimulator to remain activated, and thereby provide vibrational stimulation to the muscles of the user.

The apparatus according to the present invention may conveniently take the form of exercise apparatus, for example of the type found in a gym.

The apparatus may comprise one or more pressure sensors, and preferably comprises a first set of pressure sensors for detecting pressure applied through the hands of a user, and/or a second set of pressure sensors for detecting pressure applied through the feet of a user. The first and second sets of pressure sensors may each respectively comprise one or more individual pressure sensors. More preferably, the apparatus comprises both said first and second sets of pressure sensors.

For example, the first set of pressure sensors may detect pressure applied to a bar against which a user can push or pull with their hands. The second set of pressure sensors may detect pressure applied to a plate against which a user can push with their feet.

The pressure sensor may suitably comprise, for example, a strain gauge.

The apparatus according to the present invention may be designed for use by a user supine, or in a sitting or standing position.

The pressure sensor senses the applied pressure, which pressure value is fed to the control unit. The control unit, controls the operation of the apparatus and may be a central processing unit, or other suitable computer hardware. Thus, the control unit receives pressure values sensed by the pressure sensor, preferably stores the threshold pressure value, and activates, and preferably deactivates, the vibrational stimulator by comparing the pressure values received from the pressure sensor with the stored threshold pressure value. The control unit may perform other functions, for example it may run software which allows a user to tailor the apparatus to individual requirements, such as frequency, amplitude, direction and other characteristics of vibrations generated by the vibrational stimulator. The control unit may also store information concerning use of the apparatus by a user in a particular session, for example for later reading by a user to compare performance data from one session using the apparatus with another, or for providing real time data on display means for viewing during use of the apparatus by a user.

The apparatus according to the present invention also comprises a vibration stimulator fox applying vibrational stimulation. The apparatus preferably comprises a corresponding number of vibration stimulators and pressure sensors, i.e. in the preferred embodiments referred to above having first and second sets of pressure sensors, the apparatus will comprise; corresponding first and second vibration sensors. In this way, the pressure sensor(s) and vibrational stimulator(s) may be located in the same unit(s), i.e. the unit(s) to which a user applies pressure during use of the apparatus. Thus, in the preferred embodiments referred to above, a first vibrational stimulator may be associated with the first set of pressure sensors for detecting pressure applied through the hands of a user, and/or a second vibrational stimulator may be associated with the second set of pressure sensors for detecting pressure applied through the feet of a user.

In the particularly preferred embodiment referred to above, the first set of pressure sensors and first vibrational stimulator for application of pressure through the hands of a user may conveniently be associated with a bar against which a user can push with their hands. The second set of pressure sensors and second vibrational stimulator for application of pressure through the feet of a user may, for example, conveniently be associated with a plate against which a user can push with their feet. Thus, when the user applies a pressure to the first and second pressure sensors which exceeds the threshold pressure stored by the control unit, by applying pressure to the first set of pressure sensors through their arms, and to the second set of pressure sensors through their legs, their arms and legs will receive vibrational stimulation from the first and second vibrational stimulators respectively.

The vibrational stimulator(s) can preferably deliver vibrational stimulation to a user in a plurality of amplitudes, frequencies and directions. More preferably, the amplitude, frequency and direction of vibration may be tailored by a user via the control unit. Each vibrational stimulator may comprise one or more individual vibration engines, which may be controlled electronically according to parameters stored by the control unit. The vibrational parameters may be manually set by a user prior to use of the apparatus.

The vibrational stimulator(s) can provide vibrational stimulation to a user via a unit which can either reciprocally move relative to a user in response to the pressure sensor sensing an applied pressure which exceeds the threshold pressure or which can remain substantially stationary relative to a user. For example, in the preferred embodiment referred to above, the bar to which a user can apply pressure through their hands can be reciprocally moveable relative to the user, reciprocal movement of the bar being activated in response to the pressure sensor sensing an applied pressure which exceeds the threshold pressure, as for activation of the vibrational stimulator. Alternatively, the bar can remain substantially stationary relative to a user. Similarly, in the aforementioned preferred embodiment, the plate to which a user can apply pressure through their feet can be reciprocally moveable, activated in the same way as the bar. Alternatively, the plate can remain substantially stationary relative to a user.

The reciprocal movement may be, for example, substantially towards and away from the user in the plane of symmetry of the user, laterally in a plane substantially orthogonal to the plane of symmetry of the user, a combination of movements in both of said planes, circular movement in one or both of said planes, or a combination of any of such movements. Preferably, the direction(s) of the movement may be predetermined by the user, for example by pre-programming the control unit (e.g. via a touch screen display), as preferably may also the speed and magnitude of the reciprocal movement.

Thus, in use, a user of the apparatus according to the present invention applies an initial pressure to be sensed by the pressure sensor. The initial pressure is preferably the maximum pressure which the user can apply at that instant. The pressure sensor senses the initial pressure value, which is stored by the control unit. A threshold pressure value is then determined based upon the initial pressure value. The threshold pressure value may be any value from 0% (i.e. no pressure is required by a user to activate vibrational stimulation) to 100% (i.e. vibrational stimulation is only activated when a pressure equal to or exceeding the initial pressure value is sensed) of the initial pressure value, for example from 50 to 90% of the initial pressure value, or a narrower range of for example 70 to 80%. The threshold pressure value may be automatically set by the control unit, or may be manually set by the user.

Subsequently, each time the pressure sensor senses a pressure applied by the user which exceeds the threshold pressure value, the control unit activates the vibrational stimulator. Preferably, as referred to above, when the pressure sensor senses that the pressure applied by the user has dropped below the threshold value, the control unit deactivates the vibrational stimulator. Thus, the user will only receive vibrational stimulation when sufficient pressure is applied to activate the vibrational stimulator, according to the threshold pressure value stored by the control unit, for example as previously manually set by the user.

According to the present invention there is thus also provided a method for operating the above-described apparatus, which method comprises the user applying an initial pressure which is sensed by a pressure sensor, recording the initial pressure value sensed by the pressure sensor, and applying vibrational stimulation to the user by a vibrational stimulator in response to the user applying pressure to the pressure sensor which exceeds a threshold pressure value determined by the initial pressure value.

The apparatus and method according to the present invention thus have utility for exercising muscles, either as part of a fitness regime, or a recovery program of a user from surgery or illness. The apparatus and method according to the present invention have the particular advantage over prior apparatus and methods in that they may be specifically tailored by the user to individual requirements. The apparatus and method according to the present invention may be used as an evaluation tool for neuromuscular performance, to stimulate different muscles and joints in a user, and allows exercise or treatment at different levels of force applied by a user. However, the apparatus and method according to the present invention is also suited for use in microgravity environments, for example beyond the earth's atmosphere, where exercising with weights, for example barbells, is ineffective.

Figure 2:
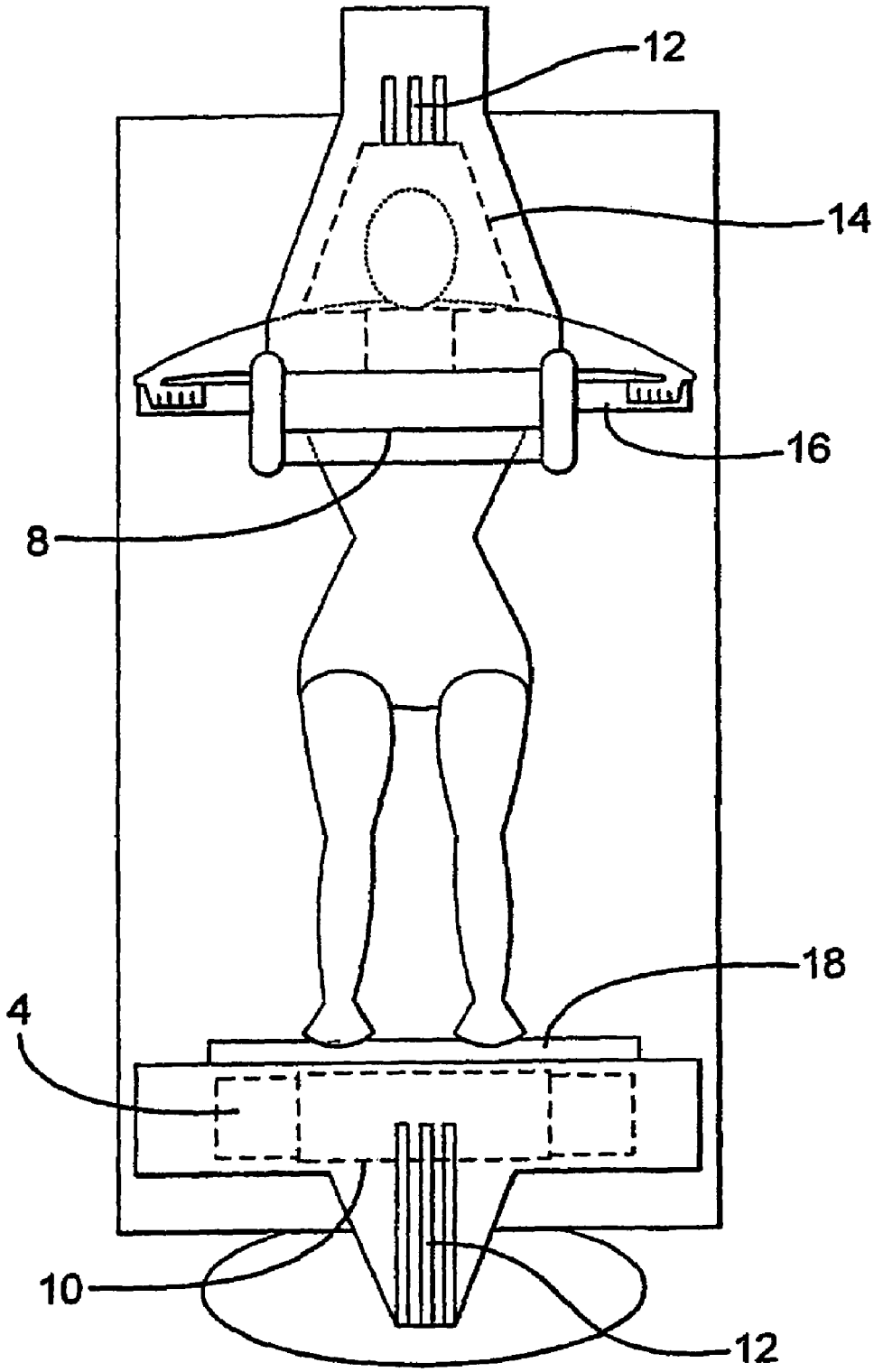

An embodiment of the present invention will now be described in detail by way of example, with reference to the accompanying drawings, in which:

FIG. 1 is a side view of a preferred embodiment of the apparatus according to the present invention; and FIG. 2 is a top view of the embodiment shown in FIG. 1

Referring to FIGS. 1 and 2, a preferred embodiment of the apparatus of the present invention comprises first and second pressure sensors 2 and 4 respectively, in the form of first and second strain gauges, a control unit 6 to which pressure values sensed by the pressure sensors 2 and 4 are fed, and first and second vibrational stimulators 8 and 10 respectively for applying vibrational stimulation to the user. The pressure values detected by the; first and second pressure sensors 2 and 4 are fed to the control unit 6 via connections 12. The apparatus further comprises a touch screen display 14 by which the user may view in real time their performance on the apparatus, and may input or change apparatus parameters, for example the threshold pressure value, or parameters of the vibrational stimulators 8 and 10.

As shown in FIGS. 1 and 2, the preferred embodiment of the apparatus according to the present invention is designed for use by a supine user. The first pressure sensor 2 and first vibrational stimulator 8 form part of a unit which comprises a bar 16 against which the user pushes through their hands to apply pressure thereto. The second pressure sensor 4 and second vibrational stimulator 10 form part of a unit which comprises a plate 18 against which the user pushes through their feet to apply pressure thereto.

The bar 16 and/or plate 18 are reciprocally moveable relative to a user in response to the first and/or second pressure sensors 2 and/or 4 respectively sensing an applied pressure which exceeds the threshold pressure. Thus, in the embodiment shown in FIGS. 1 and 2, the bar 16 is reciprocally moveable towards and away from the direction of applied pressure through the arms of the user (i.e. upwards and downwards in the view shown in FIG. 1) and/or the plate 18 is reciprocally moveable towards and away from the direction of applied pressure through the feet of the user (i.e. left and right in the view shown in FIG. 1). The direction, speed and magnitude of reciprocal movement of the bar 16 and plate 18 may be pre-determined by the user via the touch screen display 14. Thus, the user can choose to have the bar and/or plate remain substantially stationary relative to the user.

Thus, in use, in the supine position the user initially applies pressure to the bar 16 and plate 18 to their maximum ability. These initial pressure values are sensed by the first and second pressure sensors 2 and 4, and are stored in the control unit 6. The user then sets the threshold pressure value, for example 70% of the initial pressure value, using the touchscreen 14. The user then applies pressure to the bar 16 and plate 18, and whenever the first and second pressure sensors 2 and 4 sense pressure values greater than the threshold value, the control unit 6 activates the first and second vibrational stimulators 8 and 10, to thereby stimulate the arm and leg muscles respectively of the user. When the pressure value sensed by the first and/or second pressure sensors 2 and 4 drops below the threshold pressure value, then the control unit 6 deactivates the first and/or second vibrational stimulators 8 and 10 accordingly. As referred to hereinabove, the bar 16 and/or plate 18 are reciprocally moveable relative to the user in response to the first and/or second pressure sensors 2 and/or 4 respectively sensing an applied pressure which exceeds the threshold pressure.

It will be understood that the embodiment illustrated describes the invention in one form only for the purposes of illustration. In practice, the invention may be applied to many different configurations, the detailed embodiments being straightforward for those skilled in the art to implement.

The invention claimed is:

1. An exercise apparatus for muscular stimulation of a user, which apparatus comprises:

a pressure sensor, a control unit to which pressure values sensed by the pressure sensor are fed, and a vibrational stimulator for applying vibrational stimulation to a user, wherein the vibrational stimulator is adapted to be activated by the control unit in response to the pressure sensor sensing an applied pressure which exceeds a threshold pressure value, and the vibrational stimulator includes a unit having an exercise portion which is adapted to both (i) apply vibrational stimulation to the user when the vibrational stimulator is activated by the control unit, and (ii) in addition to said vibrational stimulation, cause reciprocal movement of the exercise portion in a predetermined manner relative to the user in response to the pressure sensor sensing an applied pressure exceeding the threshold pressure to induce physical exertion in the user.

2. The apparatus according to claim 1, wherein the vibrational stimulator is deactivated when the pressure sensor ceases to sense an applied pressure which exceeds the threshold pressure value.

3. The apparatus according to claim 1, which comprises a first set of pressure sensors for detecting pressure applied through the hands of the user.

4. The apparatus according to claim 3, wherein the first set of pressure sensors detects pressure applied to a bar against which a user can push or pull with their hands.

5. The apparatus according to claim 1, which comprises a second set of pressure sensors for detection of pressure applied, through the feet of a user.

6. The apparatus according to claim 5, wherein the second set of pressure sensors detects pressure applied to a plate against which user can push with their feet.

7. The apparatus according to claim 1, which comprises a first set of pressure sensors for detecting pressure applied through hands of a user and a second set of pressure sensors for detection of pressure applied through the feet of a user.

8. The apparatus according to claim 1, wherein the pressure sensor comprises a strain gauge.

9. The apparatus according to claim 1 for use by a supine user.

10. The apparatus according to claim 1, wherein the control unit comprises a central processing unit.

11. The apparatus according to claim 1, wherein the control unit allows a user to set at least one of the frequency, amplitude and direction of vibrations generated by the vibrational stimulator.

12. The apparatus according to claim 1, wherein the control unit stores information concerning use of the apparatus by a user.

13. The apparatus according to claim 1, further comprising display means for viewing during use of the apparatus by a user.

14. The apparatus according to claim 1, which comprises a corresponding number of vibration stimulators and pressure sensors.

15. The apparatus according to claim 14, which comprises a first vibrational stimulator associated with a first set of pressure sensors for detecting pressure applied through the hands of a user.

16. The apparatus according to claim 15, wherein the first set of pressure sensors and first vibrational stimulator are associated with a bar against which a user can push or pull with their hands.

17. The apparatus according to claim 14, which comprises a second vibrational stimulator associated with a second set of pressure sensors for detecting pressure applied through the feet of a user.

18. The apparatus according to claim 17, wherein the second set of pressure sensors and second vibrational stimulator are associated with a plate against which a user can push with their feet.

19. The apparatus according to claim 1, wherein the vibrational stimulator can deliver vibrational stimulation to a user in at least one of plurality of amplitudes, frequencies and directions.

20. The apparatus according to claim 19, wherein the vibrational stimulator comprises at least one individual vibration engine, which is controlled electronically according to parameters stored by the control unit.

21. The apparatus according to claim 20, wherein the parameters are manually set by a user prior to use of the apparatus.

22. The apparatus according to claim 1, which comprises a bar to which a user can apply pressure through their hands, which bar is reciprocally moveable relative to the user.

23. The apparatus according to claim 1, which comprises a plate to which a user can apply pressure through their feet, which plate is reciprocally moveable.

24. The apparatus according to claim 1, wherein the reciprocal movement is at least one movement selected from the group consisting of a movement substantially towards and away from a user in the plane of symmetry of the user, a movement laterally in a plane substantially orthogonal to the plane of symmetry of a user, a combination of movements in both of said planes, a circular movement in one or both of said planes, and a combination of any such movements.

25. The apparatus according to claim 1, wherein one of direction(s), speed and magnitude of the reciprocal movement may be predetermined by the user via the control unit.

26. The apparatus according to claim 1, wherein the unit can remain substantially stationary relative to a user.

27. A method for operating the apparatus as defined in claim 1, which method comprises providing the apparatus of claim 1, the user applying an initial pressure which is sensed by said pressure sensor, recording said initial pressure value sensed by said pressure sensor, and applying vibrational stimulation to the user by said vibrational stimulator in response to the user applying pressure to said pressure sensor which exceeds a threshold pressure value determined by said initial pressure value.

* * * * *